US008042282B2

(12) United States Patent
Oh et al.

(10) Patent No.: US 8,042,282 B2
(45) Date of Patent: Oct. 25, 2011

(54) DRUM FOR CLOTHES DRYER

(75) Inventors: Jung-Geun Oh, Gyeongsangnam-Do (KR); Sang-Ik Lee, Gyeongsangnam-Do (KR); Sang-Hun Bae, Gyeongsangnam-Do (KR); Sung-Ho Song, Busan (KR); Jae-Hak Joung, Gyeongsangbuk-Do (KR); Yoon-Seob Eom, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 568 days.

(21) Appl. No.: 11/710,400

(22) Filed: Feb. 26, 2007

(65) Prior Publication Data

US 2007/0199207 A1 Aug. 30, 2007

(30) Foreign Application Priority Data

Feb. 27, 2006 (KR) ..... 10-2006-0018962

(51) Int. Cl.
*F26B 11/02* (2006.01)

(52) U.S. Cl. ..... 34/595; 34/606; 34/610; 137/268; 604/367; 604/359; 68/212; 68/20; 8/149.2; 8/159; 126/299 D; 210/97; 210/712

(58) Field of Classification Search ..... 34/595, 34/599, 601, 602, 603, 606, 610; 8/149.2, 8/159; 68/212, 20; 210/712, 97; 126/299 D; 604/367, 359; 137/268
See application file for complete search history.

(56) References Cited

U.S. PATENT DOCUMENTS 1,393,334 A * 10/1921 Bachman ..... 241/184
1,410,936 A * 3/1922 Leaver et al. ..... 75/427
1,432,388 A * 10/1922 Davis ..... 34/604
1,448,606 A * 3/1923 Tetley ..... 55/442
1,469,975 A * 10/1923 Wagenhals ..... 68/142
1,589,740 A * 6/1926 Bonnot et al. ..... 241/54
1,624,899 A * 4/1927 Northrop ..... 271/2
1,673,483 A * 6/1928 Barker et al. ..... 241/59
1,690,712 A * 11/1928 Bonnot ..... 241/49
1,697,924 A * 1/1929 Rodolfo ..... 418/265
1,747,620 A * 2/1930 Clarke ..... 68/10
1,911,119 A * 5/1933 Ingle ..... 65/219
1,971,057 A * 8/1934 Thompson ..... 473/143
2,026,683 A * 1/1936 Johannsen ..... 75/481
2,048,743 A * 7/1936 Huebsch et al. ..... 34/599
2,111,952 A * 3/1938 Tratsch ..... 273/389
2,153,467 A * 4/1939 Hauke ..... 209/176
2,225,407 A * 12/1940 Bassett, Jr. ..... 68/12.21
2,235,467 A * 3/1941 Vetorine et al. ..... 68/20
2,276,589 A * 3/1942 Peltier et al. ..... 34/136
2,308,767 A * 1/1943 Mayes ..... 34/535
2,310,680 A * 2/1943 Dinley ..... 34/74

(Continued)

FOREIGN PATENT DOCUMENTS

CH 662058 A * 9/1987

(Continued)

*Primary Examiner* — Stephen M. Gravini
(74) *Attorney, Agent, or Firm* — Ked & Associates LLP

(57) ABSTRACT

A drum for a clothes dryer in which an internal structure, especially, a baffle structure, of the drum is improved to prevent target items from being entangled and damaged during a drying operation to thereby improve the drying efficiency of the clothes dryer. Rotatable balls are inserted in the baffles mounted on an internal surface of the drum, the mounting arrangement of the baffles is changed, or the baffles are modified to thus improve the drying operation. In addition, an absorbent is filled in the baffles to thus increase the drying efficiency.

17 Claims, 6 Drawing Sheets

U.S. PATENT DOCUMENTS

| | | | | | |
|---|---|---|---|---|---|
| RE22,375 | E | * | 9/1943 | Chamberlin et al. | 8/159 |
| 2,349,623 | A | * | 5/1944 | Hickey | 273/144 A |
| 2,460,422 | A | * | 2/1949 | Koppel | 34/606 |
| 2,495,535 | A | * | 1/1950 | Morrison | 34/76 |
| 2,495,982 | A | * | 1/1950 | Porter | 273/125 R |
| 2,503,329 | A | * | 4/1950 | Geldhof et al. | 34/604 |
| 2,507,917 | A | * | 5/1950 | Lonngren | 241/45 |
| 2,533,888 | A | * | 12/1950 | Kahn | 68/12.09 |
| 2,539,407 | A | * | 1/1951 | Dinley | 34/74 |
| 2,547,238 | A | * | 4/1951 | Tremblay | 34/603 |
| 2,555,132 | A | * | 5/1951 | Hickey | 273/148 R |
| 2,623,299 | A | * | 12/1952 | Kauffman | 34/82 |
| 2,651,509 | A | * | 9/1953 | Hyman | 34/108 |
| 2,667,905 | A | * | 2/1954 | Fritz | 99/605 |
| 2,668,717 | A | * | 2/1954 | Staub | 273/144 A |
| 2,669,456 | A | * | 2/1954 | Hickey | 273/144 A |
| 2,703,550 | A | * | 3/1955 | Bell | 118/72 |
| 2,718,066 | A | * | 9/1955 | Anthony | 34/546 |
| 2,722,750 | A | * | 11/1955 | Smith et al. | 34/82 |
| 2,722,751 | A | * | 11/1955 | Steward | 34/82 |
| 2,727,315 | A | * | 12/1955 | Candor | 34/543 |
| 2,736,970 | A | * | 3/1956 | Anthony | 34/543 |
| 2,740,364 | A | * | 4/1956 | Cote | 425/130 |
| 2,742,708 | A | * | 4/1956 | Howard | 34/76 |
| 2,748,496 | A | * | 6/1956 | Hellyer | 34/603 |
| 2,754,543 | A | * | 7/1956 | Loew | 425/114 |
| 2,775,824 | A | * | 1/1957 | Weiss | 34/90 |
| 2,783,551 | A | * | 3/1957 | Giannin | 34/602 |
| 2,798,306 | A | * | 7/1957 | Reiter | 34/609 |
| 2,798,307 | A | * | 7/1957 | Reiter | 34/610 |
| 2,807,893 | A | * | 10/1957 | Morey | 34/597 |
| 2,810,579 | A | * | 10/1957 | Hickey | 273/148 R |
| 2,818,659 | A | * | 1/1958 | Hague | 34/139 |
| 2,827,276 | A | * | 3/1958 | Racheter | 432/62 |
| 2,843,945 | A | * | 7/1958 | Whyte | 34/82 |
| 2,851,793 | A | * | 9/1958 | Thompson | 34/601 |
| 2,868,004 | A | * | 1/1959 | Runde | 68/12.15 |
| 2,886,901 | A | * | 5/1959 | Whyte et al. | 34/601 |
| 2,887,864 | A | * | 5/1959 | Tegerdine | 68/26 |
| 2,920,344 | A | * | 1/1960 | Stirling | 425/222 |
| 2,941,309 | A | * | 6/1960 | Cobb | 34/60 |
| 2,958,140 | A | * | 11/1960 | Smith | 34/598 |
| 2,975,528 | A | * | 3/1961 | Shewmon | 34/601 |
| 2,984,860 | A | * | 5/1961 | Thomas | 425/222 |
| 2,984,861 | A | * | 5/1961 | Tucker, Jr. et al. | 425/222 |
| 2,985,966 | A | * | 5/1961 | Martin | 34/75 |
| 2,986,917 | A | * | 6/1961 | Smith | 68/20 |
| 3,009,259 | A | * | 11/1961 | Simpson | 34/601 |
| 3,032,887 | A | * | 5/1962 | Whyte et al. | 34/524 |
| 3,040,440 | A | * | 6/1962 | Mellinger et al. | 34/75 |
| 3,060,593 | A | * | 10/1962 | Flora et al. | 34/601 |
| 3,064,361 | A | * | 11/1962 | Turner | 34/91 |
| 3,069,785 | A | * | 12/1962 | Mitter et al. | 34/562 |
| 3,081,554 | A | * | 3/1963 | Long | 34/543 |
| 3,114,163 | A | * | 12/1963 | Pizzi | 15/21.2 |
| 3,161,479 | A | * | 12/1964 | Biderman | 34/245 |
| 3,161,707 | A | * | 12/1964 | Stirling | 264/117 |
| 3,167,409 | A | * | 1/1965 | Brucken | 34/601 |
| 3,212,722 | A | * | 10/1965 | Maeder et al. | 241/171 |
| 3,220,120 | A | * | 11/1965 | Ross | 34/601 |
| 3,259,482 | A | * | 7/1966 | Hansen | 71/64.11 |
| 3,263,343 | A | * | 8/1966 | Loos | 34/82 |
| 3,264,089 | A | * | 8/1966 | Hansen | 71/64.11 |
| 3,264,750 | A | * | 8/1966 | Berenbaum | 34/546 |
| 3,266,168 | A | * | 8/1966 | Sones et al. | 34/546 |
| 3,270,529 | A | * | 9/1966 | Engel | 68/18 F |
| 3,295,984 | A | * | 1/1967 | Hansen | 426/2 |
| 3,313,492 | A | * | 4/1967 | Jacobs et al. | 241/21 |
| 3,322,278 | A | * | 5/1967 | Ishoy et al. | 34/319 |
| 3,330,047 | A | * | 7/1967 | Rodgers | 34/532 |
| 3,350,280 | A | * | 10/1967 | West | 202/99 |
| 3,371,547 | A | * | 3/1968 | Eckert et al. | 476/67 |
| 3,399,464 | A | * | 9/1968 | Erickson et al. | 34/605 |
| 3,409,997 | A | * | 11/1968 | Krolzick et al. | 34/601 |
| 3,427,726 | A | * | 2/1969 | Fleissner | 34/122 |
| 3,429,056 | A | * | 2/1969 | Metzger | 34/601 |
| 3,432,938 | A | * | 3/1969 | Miller | 34/533 |
| 3,454,233 | A | * | 7/1969 | Eckert et al. | 241/180 |
| 3,457,656 | A | * | 7/1969 | Fox | 34/601 |
| 3,467,073 | A | * | 9/1969 | Rhodes | 124/75 |
| 3,471,940 | A | * | 10/1969 | Smith | 34/603 |
| 3,504,444 | A | * | 4/1970 | Laue et al. | 34/131 |
| 3,507,052 | A | * | 4/1970 | Robandt | 34/380 |
| 3,545,096 | A | * | 12/1970 | Robandt et al. | 34/547 |
| 3,583,521 | A | * | 6/1971 | Anstey | 181/114 |
| 3,584,394 | A | * | 6/1971 | Grabek | 4/599 |
| 3,599,342 | A | * | 8/1971 | Cotton | 34/393 |
| 3,605,281 | A | * | 9/1971 | Hubbard et al. | 4/599 |
| 3,616,545 | A | * | 11/1971 | Jacobs | 4/599 |
| 3,634,947 | A | * | 1/1972 | Furgal | 34/60 |
| 3,651,579 | A | * | 3/1972 | Smith | 34/532 |
| 3,670,534 | A | * | 6/1972 | Gould | 69/30 |
| 3,676,199 | A | * | 7/1972 | Bond | 28/213 |
| 3,696,521 | A | * | 10/1972 | Hubbard | 34/128 |
| 3,698,095 | A | * | 10/1972 | Grand et al. | 34/333 |
| 3,782,727 | A | * | 1/1974 | Chirnomas | 273/334 |
| 3,803,725 | A | * | 4/1974 | Takeyama | 34/595 |
| 3,815,258 | A | * | 6/1974 | Beard, Jr. | 34/602 |
| 3,892,563 | A | * | 7/1975 | La Point | 241/20 |
| 3,932,006 | A | * | 1/1976 | Tertinek et al. | 384/462 |
| 3,938,260 | A | * | 2/1976 | Brenner et al. | 34/108 |
| 3,972,131 | A | * | 8/1976 | Rudy et al. | 34/60 |
| 4,007,546 | A | * | 2/1977 | Sauer | 34/602 |
| 4,014,105 | A | * | 3/1977 | Furgal et al. | 34/389 |
| 4,018,567 | A | * | 4/1977 | La Point | 422/209 |
| 4,053,992 | A | * | 10/1977 | Furgal | 34/60 |
| 4,105,813 | A | * | 8/1978 | Mizuno | 510/520 |
| 4,110,939 | A | * | 9/1978 | Bodolai | 51/298 |
| 4,137,645 | A | * | 2/1979 | Bullock | 34/467 |
| 4,137,646 | A | * | 2/1979 | Fuhring | 34/75 |
| 4,168,064 | A | * | 9/1979 | Petrovic | 473/466 |
| 4,207,686 | A | * | 6/1980 | Daily | 34/610 |
| 4,231,166 | A | * | 11/1980 | McMillan | 34/553 |
| 4,238,531 | A | * | 12/1980 | Rudy et al. | 427/242 |
| 4,288,994 | A | * | 9/1981 | Burgener | 62/381 |
| 4,326,874 | A | * | 4/1982 | Burklin | 71/9 |
| 4,327,133 | A | * | 4/1982 | Rudy et al. | 427/242 |
| 4,330,124 | A | * | 5/1982 | Vettorello | 473/526 |
| 4,407,078 | A | * | 10/1983 | Takeyama et al. | 34/601 |
| 4,421,792 | A | * | 12/1983 | Rudy et al. | 427/242 |
| 4,497,088 | A | * | 2/1985 | Lehman | 19/202 |
| 4,506,453 | A | * | 3/1985 | Shirley et al. | 34/393 |
| 4,516,335 | A | * | 5/1985 | Aoki et al. | 34/608 |
| 4,532,719 | A | * | 8/1985 | Davies et al. | 34/389 |
| 4,556,323 | A | * | 12/1985 | Elkin | 366/31 |
| 4,567,675 | A | * | 2/1986 | Rennie | 34/60 |
| 4,640,024 | A | * | 2/1987 | Files et al. | 34/608 |
| 4,700,766 | A | * | 10/1987 | Godderidge | 164/5 |
| 4,703,565 | A | * | 11/1987 | Kantor | 34/261 |
| 4,817,297 | A | * | 4/1989 | Toma et al. | 34/595 |
| 4,817,298 | A | * | 4/1989 | Toma | 34/595 |
| 4,821,496 | A | * | 4/1989 | Kysar | 56/28 |
| 4,834,385 | A | * | 5/1989 | Jackson | 273/144 A |
| 4,850,723 | A | * | 7/1989 | Whiteman, Jr. | 384/477 |
| 5,037,286 | A | * | 8/1991 | Roberts | 425/222 |
| 5,045,090 | A | * | 9/1991 | Pohl | 512/6 |
| 5,062,219 | A | * | 11/1991 | Harris et al. | 34/606 |
| 5,127,169 | A | * | 7/1992 | Ellingson | 34/601 |
| 5,207,764 | A | * | 5/1993 | Akabane et al. | 68/20 |
| 5,318,049 | A | * | 6/1994 | Henderson et al. | 131/290 |
| 5,371,956 | A | * | 12/1994 | St. Louis | 34/599 |
| 5,421,103 | A | * | 6/1995 | Wunderlich | 34/599 |
| 5,461,742 | A | * | 10/1995 | Pasad et al. | 8/149.2 |
| 5,463,821 | A | * | 11/1995 | Gauer | 34/261 |
| 5,489,150 | A | * | 2/1996 | Whiteman, Jr. | 366/46 |
| 5,564,133 | A | * | 10/1996 | Kishi | 4/111.1 |
| 5,687,591 | A | * | 11/1997 | Siklosi et al. | 68/212 |
| 5,704,557 | A | * | 1/1998 | Hallett et al. | 241/23 |
| 5,771,604 | A | * | 6/1998 | Wunderlich et al. | 34/603 |
| 5,901,465 | A | * | 5/1999 | Boussetta et al. | 34/602 |
| 5,906,056 | A | * | 5/1999 | Noguchi et al. | 34/596 |
| 6,024,226 | A | * | 2/2000 | Olivier | 209/172.5 |
| 6,088,932 | A | * | 7/2000 | Adamski et al. | 34/274 |
| 6,122,843 | A | * | 9/2000 | Noguchi et al. | 34/596 |
| 6,324,771 | B1 | * | 12/2001 | McAllister et al. | 34/595 |
| 6,381,870 | B1 | * | 5/2002 | Kohlman et al. | 34/311 |
| 6,604,297 | B2 | * | 8/2003 | Hagemann et al. | 34/380 |

| | | | | |
|---|---|---|---|---|
| 6,609,311 | B2 * | 8/2003 | Hagemann et al. | 34/597 |
| 6,643,953 | B2 * | 11/2003 | Song et al. | 34/604 |
| 6,647,643 | B2 * | 11/2003 | Song et al. | 34/595 |
| 6,658,760 | B2 * | 12/2003 | Kohlman et al. | 34/311 |
| 6,698,107 | B2 * | 3/2004 | Song et al. | 34/595 |
| 6,783,807 | B2 * | 8/2004 | Huffer et al. | 427/437 |
| 6,793,685 | B2 * | 9/2004 | Noyes et al. | 8/149.2 |
| 6,954,995 | B2 * | 10/2005 | Kitamura et al. | 34/597 |
| 6,968,632 | B2 * | 11/2005 | Guinibert et al. | 34/602 |
| 6,971,189 | B1 * | 12/2005 | Anibas | 34/602 |
| 7,025,506 | B2 * | 4/2006 | Varel et al. | 384/477 |
| 7,065,905 | B2 * | 6/2006 | Guinibert et al. | 34/603 |
| 7,117,613 | B2 * | 10/2006 | Guinibert et al. | 34/534 |
| 7,225,562 | B2 * | 6/2007 | Guinibert et al. | 34/601 |
| 7,441,345 | B2 * | 10/2008 | Taylor | 34/406 |
| 7,445,550 | B2 * | 11/2008 | Barney et al. | 463/37 |
| 7,467,483 | B2 * | 12/2008 | Guinibert et al. | 34/601 |
| 7,494,592 | B2 * | 2/2009 | Deskins | 210/712 |
| 7,500,917 | B2 * | 3/2009 | Barney et al. | 463/37 |
| 7,543,396 | B2 * | 6/2009 | Nishino et al. | 34/606 |
| 7,627,960 | B2 * | 12/2009 | Beyerle et al. | 34/602 |
| 7,649,133 | B2 * | 1/2010 | Lento | 84/422.4 |
| 7,691,261 | B2 * | 4/2010 | Deskins | 210/97 |
| 7,762,007 | B2 * | 7/2010 | Guinibert et al. | 34/601 |
| 7,921,578 | B2 * | 4/2011 | McAllister et al. | 34/597 |
| 2002/0050073 | A1 * | 5/2002 | Hagemann et al. | 34/595 |
| 2002/0078589 | A1 * | 6/2002 | Hagemann et al. | 34/597 |
| 2002/0112365 | A1 * | 8/2002 | Kohlman et al. | 34/311 |
| 2003/0000104 | A1 * | 1/2003 | Song et al. | 34/595 |
| 2003/0000105 | A1 * | 1/2003 | Song et al. | 34/595 |
| 2003/0037460 | A1 * | 2/2003 | Song et al. | 34/595 |
| 2003/0156771 | A1 * | 8/2003 | Varel et al. | 384/477 |
| 2003/0196348 | A1 * | 10/2003 | Hagemann et al. | 34/597 |
| 2003/0213145 | A1 * | 11/2003 | Hagemann et al. | 34/597 |
| 2004/0010936 | A1 * | 1/2004 | Han | 34/595 |
| 2004/0118013 | A1 * | 6/2004 | Kohlman et al. | 34/595 |
| 2004/0204240 | A1 * | 10/2004 | Barney | 463/36 |
| 2004/0216326 | A1 * | 11/2004 | Kitamura et al. | 34/597 |
| 2004/0261288 | A1 * | 12/2004 | Beyerle et al. | 34/602 |
| 2005/0070616 | A1 * | 3/2005 | Champ et al. | 521/50 |
| 2005/0076535 | A1 * | 4/2005 | Guinibert et al. | 34/601 |
| 2005/0115104 | A1 * | 6/2005 | Guinibert et al. | 34/601 |
| 2005/0143173 | A1 * | 6/2005 | Barney et al. | 463/37 |
| 2006/0006114 | A1 * | 1/2006 | Deskins | 210/724 |
| 2006/0020049 | A1 * | 1/2006 | Champ et al. | 521/99 |
| 2006/0150439 | A1 * | 7/2006 | Latack et al. | 34/601 |
| 2006/0154726 | A1 * | 7/2006 | Weston et al. | 463/37 |
| 2006/0288600 | A1 * | 12/2006 | Taylor | 34/60 |
| 2007/0186440 | A1 * | 8/2007 | Guinibert et al. | 34/603 |
| 2007/0199207 | A1 * | 8/2007 | Oh et al. | 34/602 |
| 2007/0220776 | A1 * | 9/2007 | Guinibert et al. | 34/603 |
| 2008/0014835 | A1 * | 1/2008 | Weston et al. | 446/484 |
| 2008/0022551 | A1 * | 1/2008 | Banta et al. | 34/602 |
| 2008/0022552 | A1 * | 1/2008 | Forget | 34/602 |
| 2008/0104856 | A1 * | 5/2008 | Armstrong | 34/60 |
| 2008/0114132 | A1 * | 5/2008 | Daly et al. | 525/329.5 |
| 2008/0215026 | A1 * | 9/2008 | Schornick et al. | 604/369 |
| 2009/0045138 | A1 * | 2/2009 | Champ et al. | 210/689 |
| 2009/0051653 | A1 * | 2/2009 | Barney et al. | 345/158 |
| 2009/0114567 | A1 * | 5/2009 | Maxwell | 208/126 |
| 2009/0127180 | A1 * | 5/2009 | Deskins | 210/253 |

FOREIGN PATENT DOCUMENTS

| | | | |
|---|---|---|---|
| CH | 662058 | A5 * | 9/1987 |
| CN | 1393595 | | 1/2003 |
| CN | 1414163 | | 4/2003 |
| CN | 1742788 | | 1/2006 |
| DE | 36260887 | | 2/1988 |
| EP | 298162 | A1 * | 1/1989 |
| EP | 1 270 794 | | 1/2003 |
| EP | 1 533 414 | | 5/2005 |
| JP | 02-063500 | | 3/1990 |
| JP | 04064392 | A * | 2/1992 |
| JP | 05031297 | A * | 2/1993 |
| JP | 06031099 | A * | 2/1994 |
| JP | 08117490 | A * | 5/1996 |
| JP | 08229297 | A * | 9/1996 |
| JP | 09056991 | A * | 3/1997 |
| JP | 09056994 | A * | 3/1997 |
| JP | 11290590 | A * | 10/1999 |
| JP | 2001017797 | A * | 1/2001 |
| JP | 2004-057657 | | 2/2004 |

* cited by examiner

DRUM FOR CLOTHES DRYER

BACKGROUND OF THE INVENTION

1. Field of the Invention

The present invention relates to a clothes dryer and, more particularly, to a drum for a clothes dryer which is capable of preventing target items to be dried from being twisted, entangled and damaged.

2. Description of the Related Art

In general, a clothes dryer performs drying of items to be dried (referred to as 'target items' hereinafter) by blowing air heated by a heater into a rotating drum mounted therein. The related art clothes dryers can be divided by type into an exhaust (vented) type clothes dryer and a condensing type clothes dryer according to how the moist air generated while drying target items is treated.

The exhaust type clothes dryer discharges, i.e., vents, the moist air to the exterior, while the condensing type clothes dryer condenses the moist air discharged from the drum by using a condenser to condense moisture from the air and send the de-humidified air to the drum, thus re-circulating the air.

The condensing type dryer generally includes a drum in which the laundry (namely, the target items) to be dried is loaded, a filter that filters out debris, a heat exchanging unit (or condenser) that condenses out moisture from the laundry through heat exchanging, a fan that facilitates the drying by generating an air flow, a heater that heats the air to accelerate drying, and ducts that connect the components.

FIG. 1A is a right side interior view of the prior art condensing type clothes dryer, FIG. 1B is a top internal view of the clothes dryer in FIG. 1, FIG. 2 selectively shows a drum, a belt and a motor in the dryer of FIG. 1A. The arrows 'I' in FIGS. 1A and 1B indicate the flow of external air and the arrows 'II' indicate the flow of circulating air.

With reference to FIGS. 1A and 1B, in the prior art dryer, a drum 11 that receives target items is rotatably installed within a main body 10 having a door 12 installed at its front side. The drum 11 is connected via a belt 19 with a motor 17 installed at a lower portion of the main body 10 so as to be rotated.

A condenser 13 is installed at a lower portion of the main body 10, and condenses moisture from high temperature and high moisture air circulating through the drum 11 to dry the circulating air. Front and rear sides of the condenser 13 are respectively connected with circulation ducts 14*a* and 14*b* respectively connected with front and rear sides of the drum 11. Through the circulation ducts 14, the air discharged through the drum 11 is introduced again into the drum 11 after passing through the condenser 13.

A heater 15 that heats the air which has passed through the condenser 13 and a circulation fan 16 that forcibly circulates the air through the circulation ducts 14*a* and 14*b* are respectively installed at the circulation ducts 14*a* and 14*b*. The circulation fan 16 is connected with another end of the shaft of the motor 17 that drives the drum 11.

In order to condense the air circulating through the circulation duct 14*a* by heat exchanging at the condenser 13, external cold air is supplied to the condenser 13. For this purpose, an external air supply duct 18 communicating with the outside is connected with one side of the condenser 13 and a cooling fan 20 that forcibly draws external air in through the external air supply duct 18 and discharges it into the main body 10 and a cooling fan driving motor 21 are installed at the other side of the condenser 13 where the external air supply duct 18 is connected. Reference numeral 22 indicates a filter that filters out debris such as waste pieces of thread from the air discharged into the circulation duct 14*a* through the front side of the drum 11.

A water receiver (not shown) for collecting condensation water dropped after being generated during the condensing process is installed at a lower portion of the condenser 13, and a pump 23 is installed in order to send the condensation water collected in the water receiver to a condensation water storage tank 2.

The process of drying laundry in a clothes dryer having the construction as described above will now be described.

With reference to FIG. 2A, the belt 19 connected with a driving shaft of the motor 17 is wound on an outer circumferential surface of the drum 11 to transfer the rotary force from the motor 17 to the drum 11. A plurality of baffles 11' are mounted on the inner surface of the drum and move to baffle and tumble the target items during the forward or backward rotation of the drum 11. Herein, the baffles 11' serve to push the target items upward within the drum 11 in the operation of the clothes dryer.

When a large load of target items is received in the drum 11, the target items are apt to become entangled due to frictional contact between the baffles 11' and the target items during operation of the dryer. In addition, when the rotation of the drum 11 is changed from a forward direction to a backward direction or from the backward direction to the forward direction, the baffles 11' and the clothes (namely, the target items to be dried) contact frictionally, causing the target items to become entangled and possibly damaged.

SUMMARY OF THE INVENTION

Therefore, in order to address the above problems the various features described herein have been conceived. One aspect of the exemplary embodiments is to provide a drum for a clothes dryer which is capable of preventing target items from being entangled or damaged.

Another aspect of the exemplary embodiments is to provide a drum for a clothes dryer which is capable of providing improved drying performance.

This specification provides a drum for a clothes dryer, in which the drum has a horizontal rotational axis and a plurality of baffles provided on an inner circumferential surface of the drum each include a plurality of balls therein.

The balls positioned in the baffles can be rotatable within the baffles and at least a portion of each ball is exposed at the surface of the baffles.

This specification also discloses a drum for a clothes dryer, which drum has a horizontal rotational axis, and a plurality of baffles provided on an inner circumferential surface of the drum each have a length smaller than one-half of an internal depth of the drum and are mounted within the drum such that they parallely interdigitate relative to each other in a depthwise direction of the drum, and may be integrally formed with the drum.

This specification also discloses a drum for a clothes dryer, wherein the drum has a horizontal rotational axis and a plurality of baffles provided on an inner circumferential surface of the drum have crenellated (i.e., castellated) upper surfaces.

This specification also discloses a drum for a clothes dryer, wherein the drum has a horizontal rotational axis and a plurality of baffles provided on an inner circumferential surface of the drum have an absorbent material that can collect moisture therein, respectively.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1A:
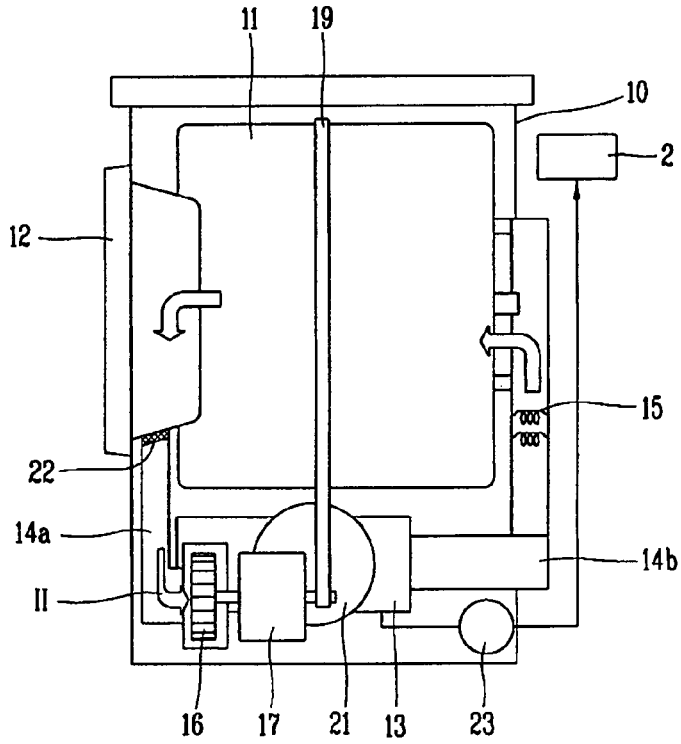
FIG. 1A is a side interior view of a typical prior art clothes dryer.
Figure 1B:
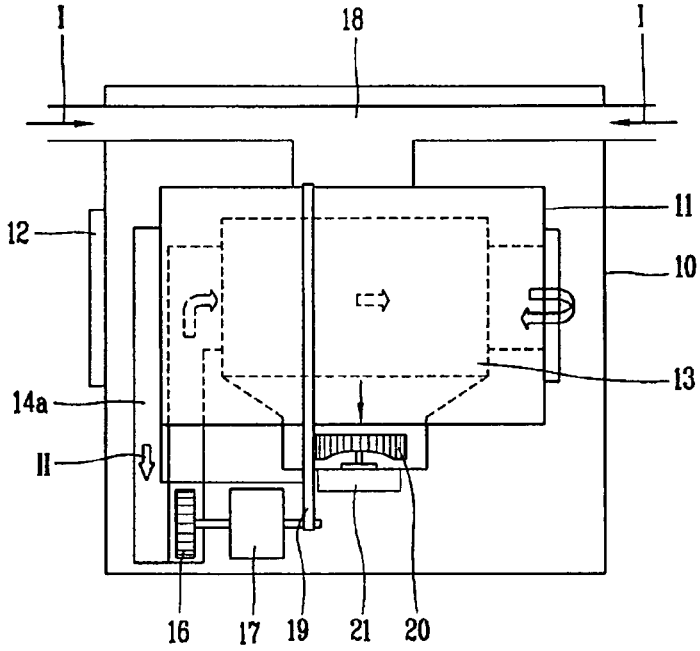
FIG. 1B is a top interior view of the clothes dryer in FIG. 1A.
Figure 2:
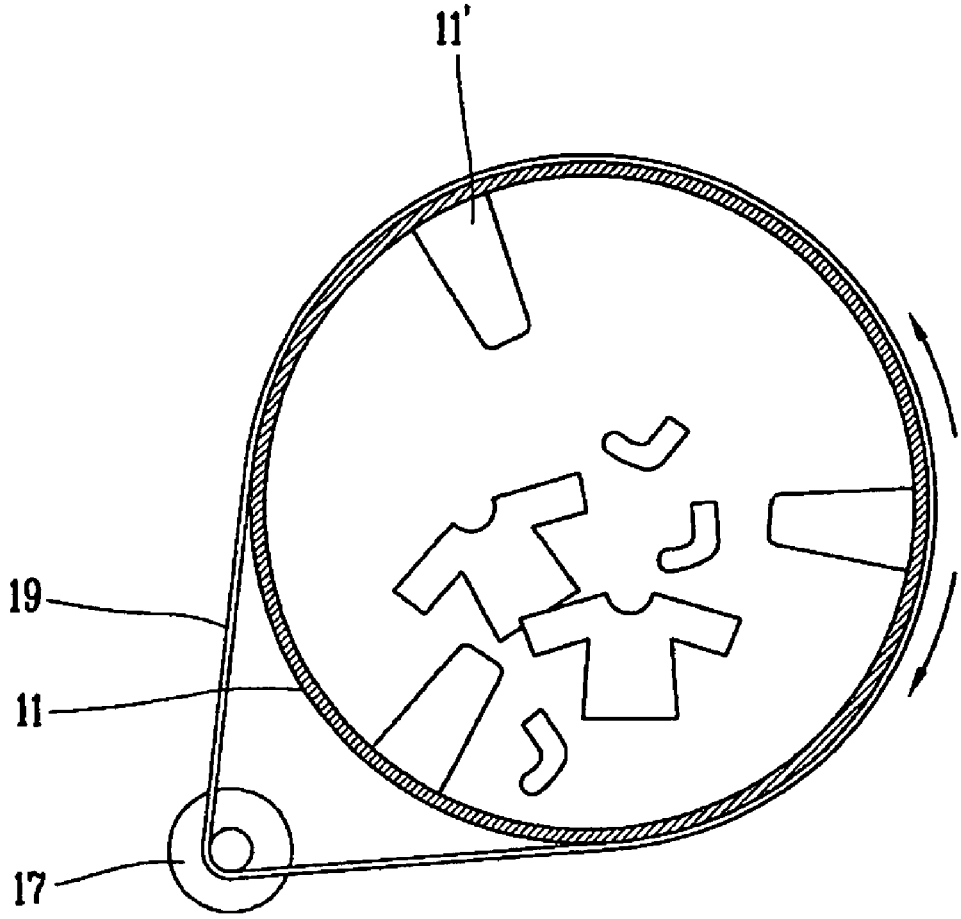
FIG. 2 is a view selectively showing a drum having baffles therein, a belt and a motor in the dryer of FIG. 1A.
Figure 3A:
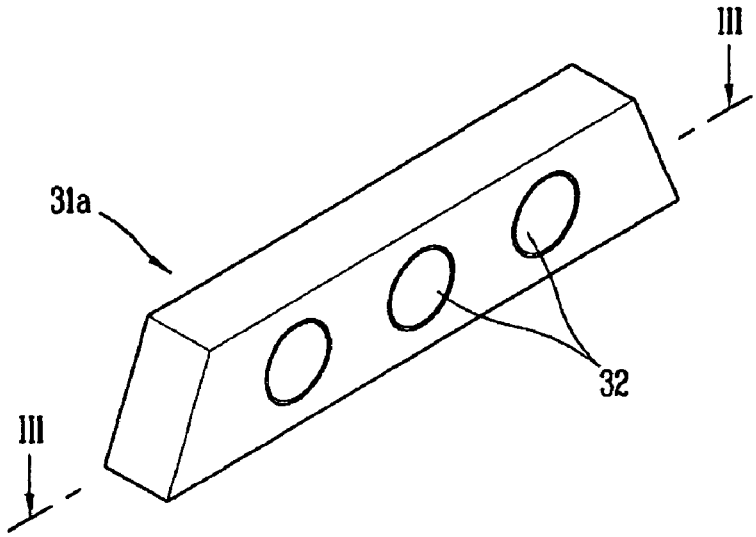
FIG. 3A is a perspective view of a baffle of the drum according to a first embodiment of the present invention.

The drum for a clothes dryer according to exemplary embodiments of the present invention will now be described with reference to the accompanying drawings. FIG. 3A is a perspective view showing a baffle of the drum according to a first exemplary embodiment of the present invention, and FIG. 3B is a cross-sectional view taken along line III-III in FIG. 3A.

Figure 3B:
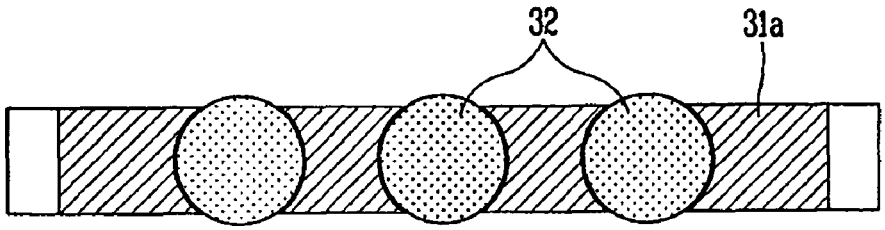
FIG. 3B is a cross-sectional view taken along line III-III in FIG. 3A.

With reference to FIGS. 3A and 3B, a baffle 31*a* of the drum according to the first exemplary embodiment of the present invention has a bar-shaped structure and includes a plurality of balls 32. The balls 32 are rotatably carried inside the baffle 31*a*.

The balls 32 have certain firmness and elasticity so as to be freely rotatable in the baffle 31*a*.

The balls 32 are not limited in their size, but preferably, the balls 32 have such a suitable diameter that their portions are exposed to the surface of the baffle 31*a* of the balls 32 so that when target items and the baffle 31*a* contact frictionally during rotation of the drum 11 when the clothes dryer is operated, the target items can naturally get out of contact with the baffle 31*a* according to the rotation of the balls 32.

As for the number of balls 32, three or five balls can be inserted in consideration of the general size of the baffle 31*a* so that the baffle 31*a* and the target items may maintain a proper frictional contact therebetween.

The structure of the baffle 31*a* with the plurality of balls 32 positioned therein allows the reduction of entanglement of the target items even when a large load of the target items is placed within the drum 11, and especially, the reduction of damage of the target items caused by frictional contact between the baffle 31*a* and the target items.

Regarding the insertion of the plurality of balls 32 in the baffle 31*a*, the balls 32 can be inserted in a fabrication process of the baffle 31*a* and then the baffle 31*a* can be mounted within the drum 11, and alternatively, in a state that the baffle 31*a* is already mounted within the drum, the elastic balls 32 can be inserted into the baffle 31*a*.

In the first exemplary embodiment of the present invention, the baffle 31*a* has a rectangular shape in its transverse section and takes a bar shape with a certain length, and can either be mounted onto the internal surface of the drum or can be integrally formed with the drum.

Figure 4A:
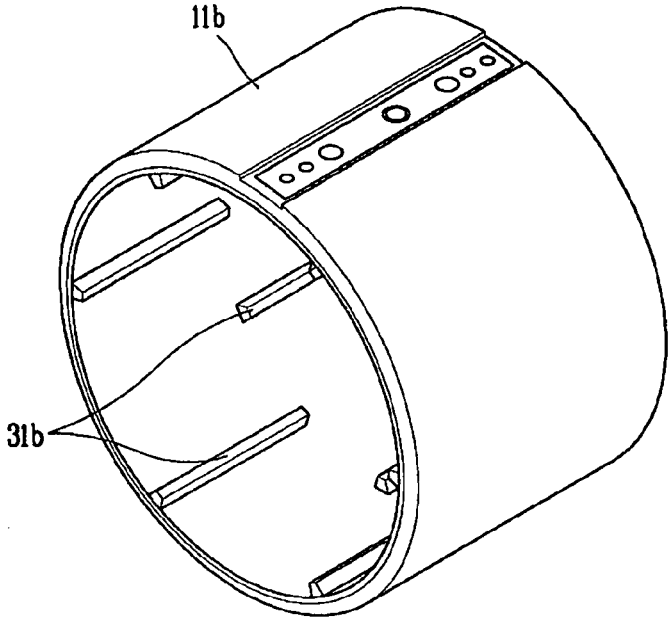
FIGS. 4A and 4B are respective perspective and side views showing a dryer drum equipped with baffles according to a second exemplary embodiment of the present invention.
Figure 4B:
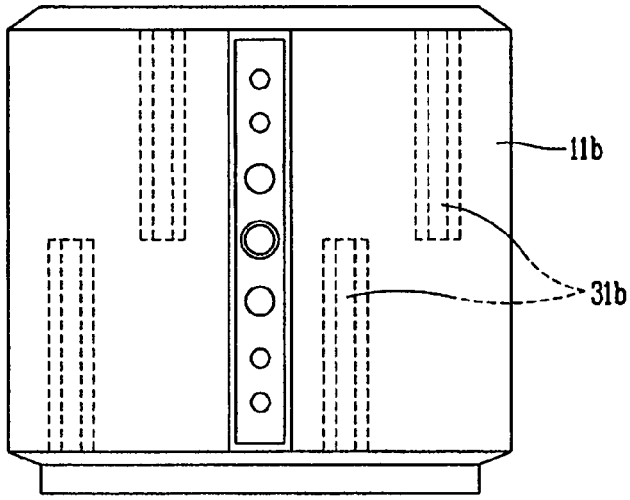

FIGS. 4A and 4B show a drum fitted with baffles according to a second exemplary embodiment of the present invention.

With reference to FIGS. 4A and 4B, baffles 31*b* with a length shorter than one-half of that of the drum 11*b* in a lengthwise direction of the drum 11*b* are mounted on the interior surface of the drum 11*b*. The baffles 31*b* are arranged in a zigzag or interdigitated at certain intervals on forward and rearward interior portions in the lengthwise direction of the drum 11*b*. Because the space between baffles 31*b* is reduced, the target items (to be dried) received within the drum 11*b* can be easily mixed, and because the baffles 31*b* with the reduced length are mounted zigzagwise, frictional contact with the baffles 31*b* can be more reduced. Accordingly, occurrence of entanglement between the baffles 31*b* and the target items can be reduced, and thus, damage to the target items can be reduced.

The baffles 31*b* can be mounted within the drum 11*b*, or when the drum is initially fabricated, the baffles 31*b* can be integrally formed zigzagwise with the drum 11*b*.

Figure 5A:
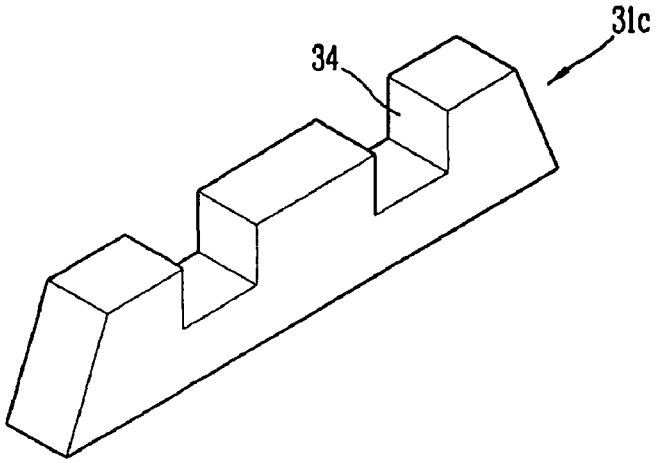
FIGS. 5A and 5B are respective perspective and side views showing a baffle according to a third exemplary embodiment of the present invention.
Figure 5B:
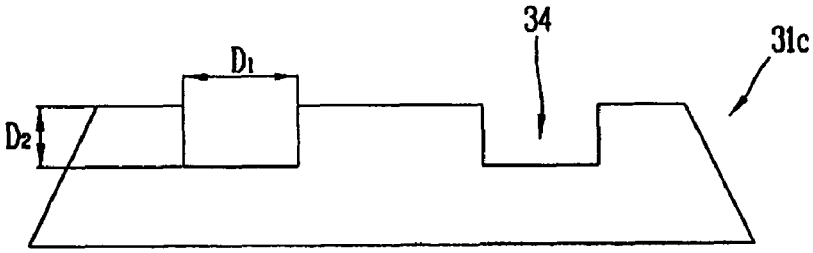

FIGS. 5A and 5B show baffles according to a third exemplary embodiment of the present invention.

With reference to FIGS. 5A and 5B, the baffles within the drum according to the third exemplary embodiment of the present invention are 'crenellated' and includes notches or recesses 34 in the upper portion thereof. With the baffle 31*c* having the recesses 34, the relatively concave and convex surface portions of the recesses 34 work to cause the target items to be smoothly mixed during a drying operation. In addition, even when a large amount of target items are loaded into the drum 11, occurrence of entanglement among the target items can be reduced. One or more recesses, preferably, two or more recesses, in the notched form are formed in the baffle 31*c*, and may be modified to have a rectangular shape, a hexagonal shape or a circular shape, etc. As for the size of the recesses 34, the width D1 and the height D2 may be the same, or the width D1 can be greater than the height D2. The height D2 of the recess is one-third or two-thirds of the height of the baffle 31*c*.

Because the baffle 31*c* has the notched recesses 34, the internal volume of the drum 11 is increased by the area corresponding to the recesses 34, and accordingly, the capacity of the target items that can be received within the drum 11 can increase.

Figure 6:
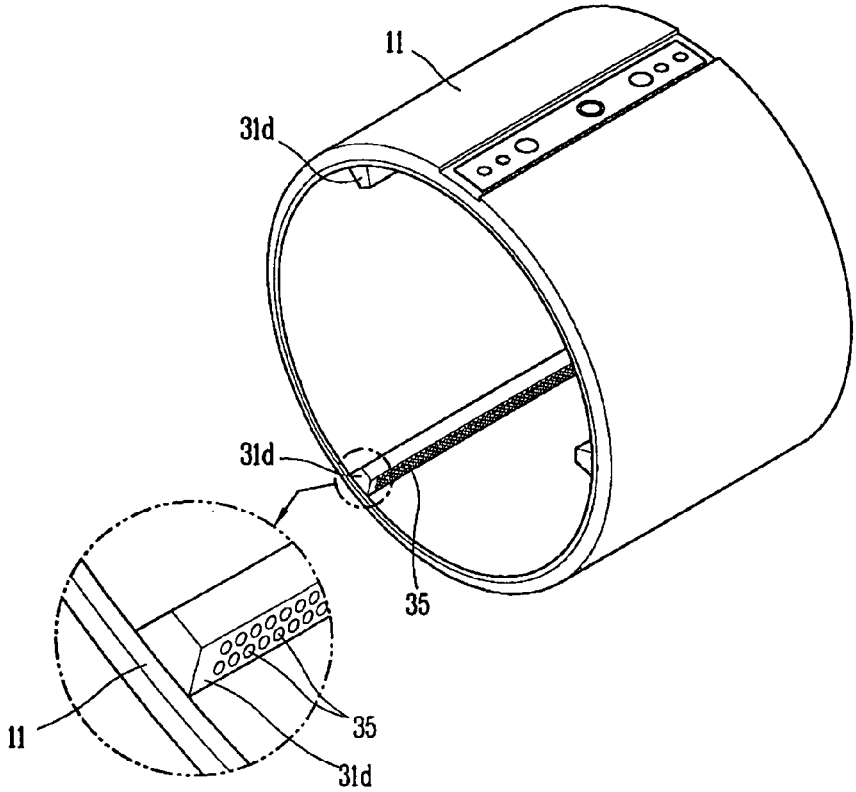
FIG. 6 is a perspective view showing a baffle of the drum according to a fourth exemplary embodiment of the present invention.

FIG. 6 is a perspective view showing a baffle in the drum according to a fourth exemplary embodiment of the present invention.

The baffle according to the fourth exemplary embodiment of the present invention has an additional function for playing an auxiliary role for drying the target items. Namely, an absorbent (not shown) is provided in the baffle 31*d*.

A plurality of air pores 35 are formed on a front surface of a central portion of the baffle 31*d*, in which the absorbent is filled and mounted in an airtight state in the drum 11. When the drum 11 is rotated, moisture of the target items is absorbed by the absorbent to thus increase the drying efficiency.

Without the target items, a certain amount of heat is applied to the interior of the drum 11 to remove moisture included in the absorbent, whereby the absorbent filled in the baffle 31*d* can be continuously re-used.

Figure 7:
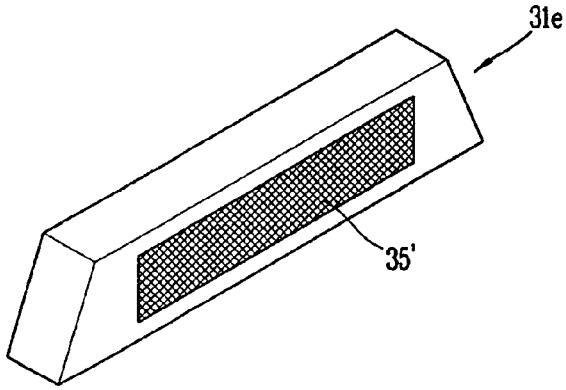
FIG. 7 is a perspective view showing a baffle of the drum according to a fifth exemplary embodiment of the present invention.

FIG. 7 is a perspective view a baffle of the drum according to a fifth exemplary embodiment of the present invention.

After a certain time elapses, the absorbent filled in the baffle 31*e* may need to be changed. For this purpose, an absorbing module 35' having an absorbent is changeably mounted inside the baffle 31*e* in the drum according to the fifth exemplary embodiment of the present invention.

After the dryer is used for a certain period of time, when the time for changing the absorbent arrives, the absorbing module 35' is removed from the baffle 31*e* and a new absorbing module is mounted in the baffle 31*e*, so that an absorption efficiency of more than a certain level can be obtained.

The above-described embodiments can be complemented and combined in implementation. Namely, a baffle formed by incorporating the characteristics of the first to fifth embodiments of the present invention can be installed in the drum.

As so far described, the drum for a clothes dryer according to the present invention has the advantages that, by improving the internal structure, namely, the structure of the baffles, of the drum, the target items can be prevented from being entangled or damaged during the drying operation, and thus, the drying efficiency can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A clothes dryer, comprising:
- a main body;
- a drum disposed within the main body;
- a door provided in the main body through which clothes to be dried are introduced into the drum;
- a motor that rotates the drum;
- a heater that heats air to be provided to the drum; and
- a plurality of baffles provided on an inner circumferential surface of the drum, each of the plurality of baffles including a plurality of balls fixed therein so as to be freely rotatable inside the respective baffle.

2. The clothes dryer of claim 1, wherein at least one portion of each ball is exposed at a surface of the respective baffle.

3. The clothes dryer of claim 1, wherein the plurality of balls comprises 3 to 5 balls.

4. The clothes dryer of claim 1, wherein the plurality of baffles each have a rectangular shaped cross section, are formed in a bar shape with a certain length, and are mounted on an inner circumferential surface of the drum or integrally formed with the drum.

5. The clothes dryer of claim 1, wherein the plurality of baffles have a length less than one-half of an internal depth of the drum, and are mounted within the drum such that they are staggered and interdigitated in a lengthwise direction of the drum.

6. The clothes dryer of claim 1, wherein the plurality of baffles each have a plurality of recesses formed in an upper portion thereof.

7. The clothes dryer of claim 1, wherein the plurality of baffles each include an absorbent that collects moisture therein.

8. A clothes dryer, comprising:
- a main body;
- a drum disposed within the main body;
- a door provided in the main body through which clothes to be dried are introduced into the drum;
- a motor that rotates the drum;
- a heater that heats air to be provided to the drum.; and
- a plurality of baffles, each having a length less than one-half of an internal depth of the drum, provided on an inner circumferential surface of the drum such that they are staggered relative to each other in a depthwise direction of the drum and do not extend the entire length of the drum.

9. The clothes dryer of claim 8, wherein the plurality of baffles each have a plurality of recesses formed at in upper portion thereof.

10. The clothes dryer of claim 8, wherein the plurality of baffles each include an absorbent that collects moisture therein.

11. A clothes dryer, comprising:
- a main body;
- a drum disposed within the main body;
- a door provided in the main body through which clothes to be dried are introduced into the drum;
- a motor that rotates the drum;
- a heater that heats air to be provided to the drum; and
- a plurality of baffles provided on an inner circumferential surface of the drum, each of the plurality of baffles including a plurality of recesses formed in an upper surface thereof.

12. The clothes dryer of claim 11, wherein the plurality of baffles each include an absorbent that collects moisture therein.

13. A clothes dryer, comprising:
- a main body;
- a drum disposed within the main body;
- a door provided in the main body through which clothes to be dried are introduced into the drum;
- a motor that rotates the drum;
- a heater that heats air to be provided to the drum; and
- a plurality of baffles provided on an inner circumferential surface of the drum, each of the plurality of baffles including an air pore structure formed in a front surface thereof and including an absorbent that collects moisture disposed therein.

14. The clothes dryer of claim 11, wherein the plurality of recesses are each rectangular in shape, hexagonal in shape, or circular in shape.

15. The clothes dryer of claim 11, wherein the plurality of recesses are rectangular in shape, each having a height in a range of one-third to equal to a width of the respective recess.

16. The clothes dryer of claim 11, wherein the plurality of recesses are rectangular in shape, each having a height less than a width of the respective recesses.

17. The clothes dryer of claim 11, wherein the plurality of recesses each extends down from an upper surface of the respective baffle less than half a height of the respective baffle.

* * * * *